US006873294B1

(12) United States Patent
Anderson et al.

(10) Patent No.: US 6,873,294 B1
(45) Date of Patent: Mar. 29, 2005

(54) ANTENNA ARRANGEMENT HAVING MAGNETIC FIELD REDUCTION IN NEAR-FIELD BY HIGH IMPEDANCE ELEMENT

(75) Inventors: Eric A. Anderson, Crystal Lake, IL (US); Benjamin O. White, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 48 days.

(21) Appl. No.: 10/658,183

(22) Filed: Sep. 9, 2003

(51) Int. Cl.[7] ..... H01Q 1/26; H01Q 1/38
(52) U.S. Cl. ..... 343/702; 343/700 MS
(58) Field of Search ..... 343/702, 700 MS, 343/745, 754, 815

(56) References Cited

U.S. PATENT DOCUMENTS 4,367,474 A * 1/1983 Schaubert et al. ... 343/700 MS
4,777,490 A * 10/1988 Sharma et al. ..... 343/754
5,585,810 A * 12/1996 Tsuru et al. ..... 343/745
5,668,560 A * 9/1997 Evans et al. ..... 343/702
6,034,636 A * 3/2000 Saitoh ..... 343/700 MS
6,255,994 B1 * 7/2001 Saito ..... 343/700 MS
6,421,016 B1 7/2002 Phillips et al.
6,466,170 B2 * 10/2002 Zhou ..... 343/700 MS
2002/0140607 A1 * 10/2002 Zhou ..... 343/700 MS
2003/0214443 A1 * 11/2003 Bauregger et al. ... 343/700 MS
2004/0041733 A1 * 3/2004 Milosavijevic ..... 343/700 MS

* cited by examiner

*Primary Examiner*—Don Wong
*Assistant Examiner*—Hung Tran Vy
(74) *Attorney, Agent, or Firm*—Hisashi D. Watanabe

(57) ABSTRACT

An apparatus and a method for reducing magnetic field in near-field by presenting high impedance at an operating frequency band are disclosed. A conducting element (112), which is suspended substantially parallel to a first side (104) of a printed circuit board (102) of a wireless portable communication device (100) over an electrically grounded conductor (116), forms a reactive element. The reactive element provides high impedance at operating frequencies of the wireless portable communication device and diverts radio frequency currents from the first side of the printed circuit board to the second side of the printed circuit board such that a magnetic field produced by the radio frequency currents on the first side of the printed circuit board is reduced in the near-field.

20 Claims, 6 Drawing Sheets

ANTENNA ARRANGEMENT HAVING MAGNETIC FIELD REDUCTION IN NEAR-FIELD BY HIGH IMPEDANCE ELEMENT

FIELD OF THE INVENTION

The present invention generally relates to a method and an apparatus for an antenna arrangement, and more specifically to a method and an apparatus for an antenna arrangement reducing undesired magnetic field in a near-field.

BACKGROUND OF THE INVENTION

As wireless portable communication devices, such as cellular telephones, are made smaller, corresponding components including antennas used for those devices are also made smaller, and/or are sometimes at least partially integrated with other components. As a result, a printed circuit board ("PCB"), which is populated with electronic and mechanical components, is effectively used as part of radiating antenna elements of the wireless portable communication device. Radio frequency ("RF") current flows on the PCB and the PCB acts as an antenna. For cellular telephones operating in lower frequency band such as Global System for Mobile Communications ("GSM"), which covers the frequency band from about 880 MHz to 960 MHz, and Advanced Mobile Phone System ("AMPS"), which covers the frequency band from about 824 MHz to 894 MHz, the effect of the PCB radiation is more apparent compared to cellular telephones operating in higher frequency band such as Personal Communications Services ("PCS"), which covers the frequency band from about 1850 MHz to 1990 MHz. Because the size of an antenna is typically made to have an electrical length corresponding to the wavelength of the frequency used, the size of the antenna is generally larger for a lower frequency application.

By using a PCB of a cellular telephone as a radiating element, the radiating efficiency of the cellular telephone may be easily degraded due to the PCB being in close proximity to a user's body. For example, when a cellular telephone is used, it is typically held in a user's hand, which essentially covers one side of the PCB, and the other side of the PCB is held against the user's face. When the cellular telephone is carried in a user's pocket or is carried by a belt-clip, one side of the PCB faces the user's body. This presence of the user's body in close proximity to the PCB, which is being used as a radiating element, may significantly affect the radiation efficiency of the cellular telephone.

A cellular telephone may use a variety of types of antennas, such as a helical antenna and an internal antenna. The helical antenna may be viewed as a dipole-like structure comprising the antenna as a quarter-wave radiator and the PCB as another quarter-wave radiator. The internal antenna may be viewed as a matching network to the PCB for the 824–960 MHz bands of operation. Compared to the PCB, the antenna itself is generally much smaller in volume, and therefore contains more concentrated radiation energy than the PCB. To reduce the degradation in efficiency due to the presence of the user's body in close proximity, the antenna is typically located in the cellular telephone where it is kept away from the body of the user. However, the PCB, having RF currents flowing and emitting radiation, is still kept next the user's body, and the radiation efficiency of the cellular telephone is still considerably susceptible to the proximity of the user's body to the PCB.

DETAILED DESCRIPTION OF THE PREFERRED EMBODIMENTS

The present invention provides a method and an apparatus for an antenna arrangement suitable for a wireless portable communication device, such as a cellular telephone, that reduces undesired magnetic field in a near-field. The near-field is generally defined as an area or a volume defined by a distance of a few wavelengths of operating radio frequency from an origin of radio frequency radiation, such as an antenna of the cellular telephone. In a typical cellular telephone usage, a user may place the cellular telephone in a pocket, may clip it to his belt, or may hold in his hand and hold it against his face. Therefore, when the cellular telephone transmits a signal, part of the user's body is placed in the near-field created by the transmitted signal, and attenuates the transmitted signal, which results in reducing a usable transmitted power of the cellular telephone. It is generally desirable to direct the transmitted power away from the user. By reducing the transmitted power towards the user while maintaining the total transmitted power, the usable transmitted power is effectively increased. The transmitted power from the cellular telephone at radio frequency can be considered as a product of an electric field and a magnetic field produced by a transmitter of the cellular telephone and radiated from the antenna and a printed circuit board of the cellular telephone. Because the magnetic field is proportional to a current flow, the magnetic field may be reduced by reducing the current flow. Therefore, by reducing the current flow, which reduces the magnetic field, the transmitted power, as the product of the electric field and now the reduced-magnetic field, can be reduced. By reducing the current flow in an appropriate place, the resulting transmitted power towards the user can be reduced, without reducing the total transmitted power, effectively improving the usable transmitted power.

Figure 1:
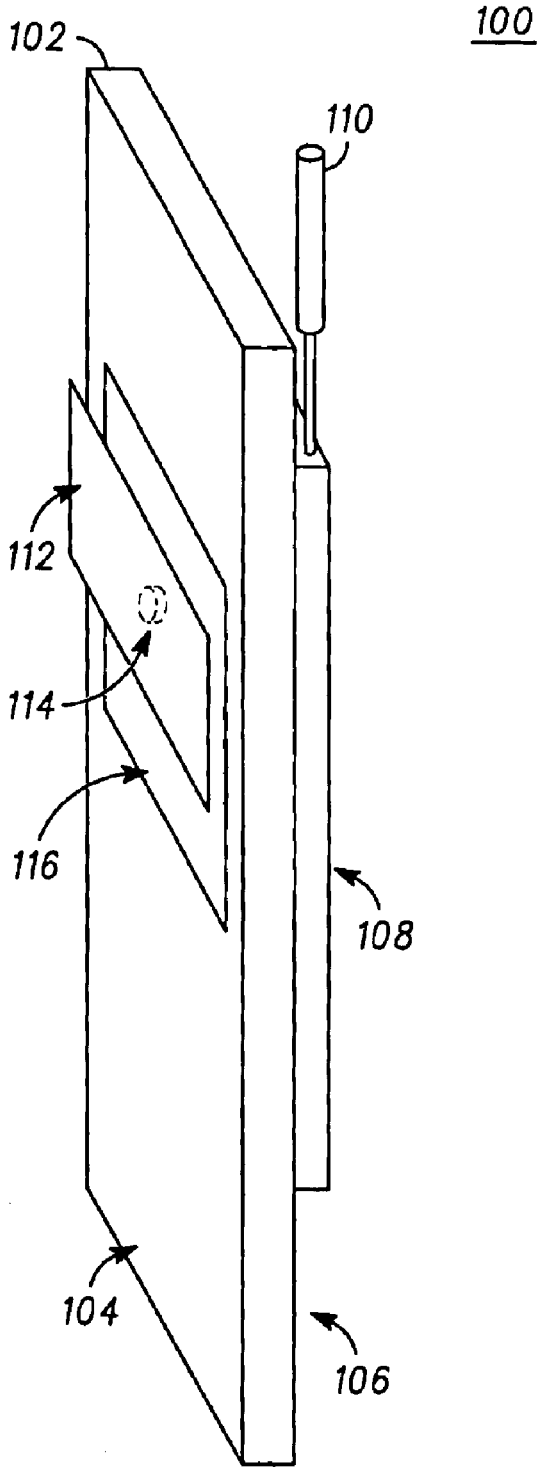
FIG. 1 is an exemplary diagram of a first embodiment of an antenna arrangement for a wireless portable communication device in accordance with the present invention.

FIG. 1 is an exemplary diagram of a first embodiment of an antenna arrangement for a wireless portable communication device 100 in accordance with the present invention.

The wireless portable communication device 100 comprises a printed circuit board 102, which has a first side 104 and a second side 106, a transceiver 108, which includes a transmitter, a receiver, and a controller, disposed on the second side of the printed circuit board 102, an antenna 110 coupled to the transceiver 108, and a conducting element 112 suspended parallel to the printed circuit board 102 over the first side 104. The conducting element 112 is supported by a post 114. An area on the first side 104 of the printed circuit board 102 under the conducting element 112 is substantially covered by a conductor 116, which is electrically grounded, and the conducting element 112 and the conductor 116 form a capacitor. A capacitance of the capacitor formed is proportional to an area of the conducting element 112 and is also inversely proportional to the distance between the conducting element 112 and the conductor 116. Mathematically, the capacitance, C in Farads ("F"), can be expressed as:

$$C = \frac{A\varepsilon}{h},$$

where A, in square meters ("$m^2$"), is the area of the conducting element 112, $\epsilon$, in Farads per meter ("F/m"), is the dielectric constant of a material between the conducting element 112 and the conductor 116, and h, in meters ("m"), is the distance between the conducting element 112 and the conductor 116.

The post 114, which supports and electrically connects to the conducting element 112, is also electrically grounded through the conductor 116, and behaves as an inductor. An inductance of the inductor, L in Henries ("H"), is proportional to the length of the post 114, and can be expressed mathematically as:

$$L=\alpha h,$$

where $\alpha$ in Henries per meter ("H/m") is a constant based upon a thickness of the post 114, and h, in meters, again is the distance between the conducting element 112 and the conductor 116, which is the length of the post 114.

A resonant frequency of the combination of the capacitor and the inductor, at which the impedance of the combination of the capacitor and the inductor approaches infinity, is inversely proportional to a square root of the product of the capacitance and the inductance. Mathematically, the resonant frequency, f, can be expressed as:

$$f = \frac{1}{2\pi\sqrt{LC}} = \frac{1}{2\pi\sqrt{\alpha h\frac{A\varepsilon}{h}}} = \frac{1}{2\pi\sqrt{\alpha A\varepsilon}}.$$

Therefore, the resonant frequency of the conducting element 112 can be adjusted to be equal to a desired frequency by varying any one or more of the terms present in the above equation.

When the wireless portable communication device 100 transmits a signal at a desired transmit frequency, radio frequency power associated with the signal is radiated from the antenna 110 as well as the printed circuit board 102 due to radio frequency currents generated by the transmitter of the transceiver 108 flowing on the printed circuit board 102. However, by adjusting the resonant frequency of the conducting element 112 to be the desired transmit frequency, the radio frequency currents flowing on the first side 104 of the printed circuit board 102 encounters high impedance at the conducting element 112, and a portion of the radio frequency currents is diverted to the second side 106 of the printed circuit board 102. Because the flow of the radio frequency currents on the first side 104 is reduced by diverting the radio frequency currents to the second side 106, the magnetic field in the near-field produced by the radio frequency currents on the first side 104 is reduced, thereby reducing the radiated radio frequency power from the first side 104 of the printed circuit board 102. By reducing the radiated radio frequency power from the first side 104 of the printed circuit board 102 without changing the total power transmitted by the transmitter of the transceiver 108, the radiated radio frequency power from the second side 106 of the printed circuit board 102 is effectively increased, thereby increasing an effective, or usable, radiated radio frequency power of the transceiver 108.

Figure 2:
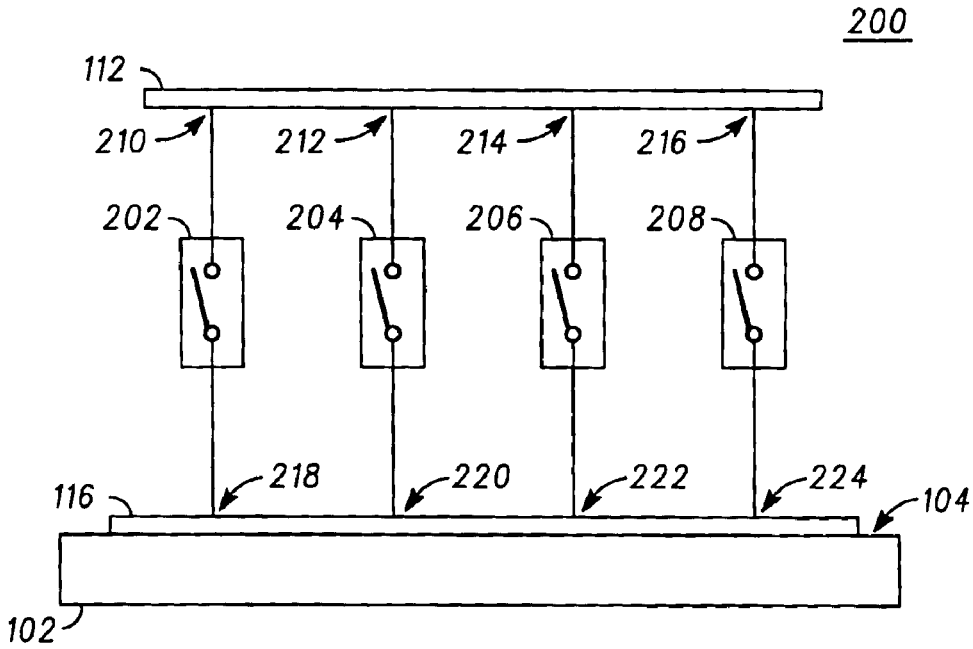
FIG. 2 is an exemplary block diagram of a second embodiment of the antenna arrangement having a plurality of switches in accordance with the present invention.

FIG. 2 is an exemplary block diagram of a second embodiment of an antenna arrangement 200 for the wireless portable communication device 100 in accordance with the present invention. FIG. 2 illustrates a side view of the conducting element 112 and the conductor 116, which is electrically grounded, disposed on the first side 104 of the printed circuit board 102. Instead of the post 114, which provides a fixed inductance at a fixed location, in the second embodiment of the antenna arrangement 200 provides a plurality of switches (only four switches, 202, 204, 206, and 208 are shown) configured to electrically couple from a plurality of element locations (only four element locations, 210, 212, 214, and 216 are shown) of the conducting element 112 to a plurality of conductor locations (only four conductor locations, 218, 220, 222, and 224 are shown) of the conductor 114. By varying the location where the conducting element 112 is coupled to the conductor 114, by varying the number of locations where the conducting element 112 is coupled to the conductor 114, or by varying the locations and the number of locations where the conducting element 112 is coupled to the conductor 114, a resulting reactance can be varied to achieve a desired effect of producing high impedance for the given desired transmit frequency to reduce radio frequency current flow on the first side 104 of the printed circuit board 102. For multiple frequency band operations, different sets of switches may be activated with each set of switches corresponding to a specific band. For example, a dual band cellular telephone having a first band at GSM 900 MHz band and a second band at GSM 1900 MHz, the switches 202, 204, and 206 may be activated to achieve a desired effect of producing high impedance at the 900 MHz band while only the switch 208 may be activated to achieve a desired effect of producing high impedance at the 1900 MHz band.

Figure 3:
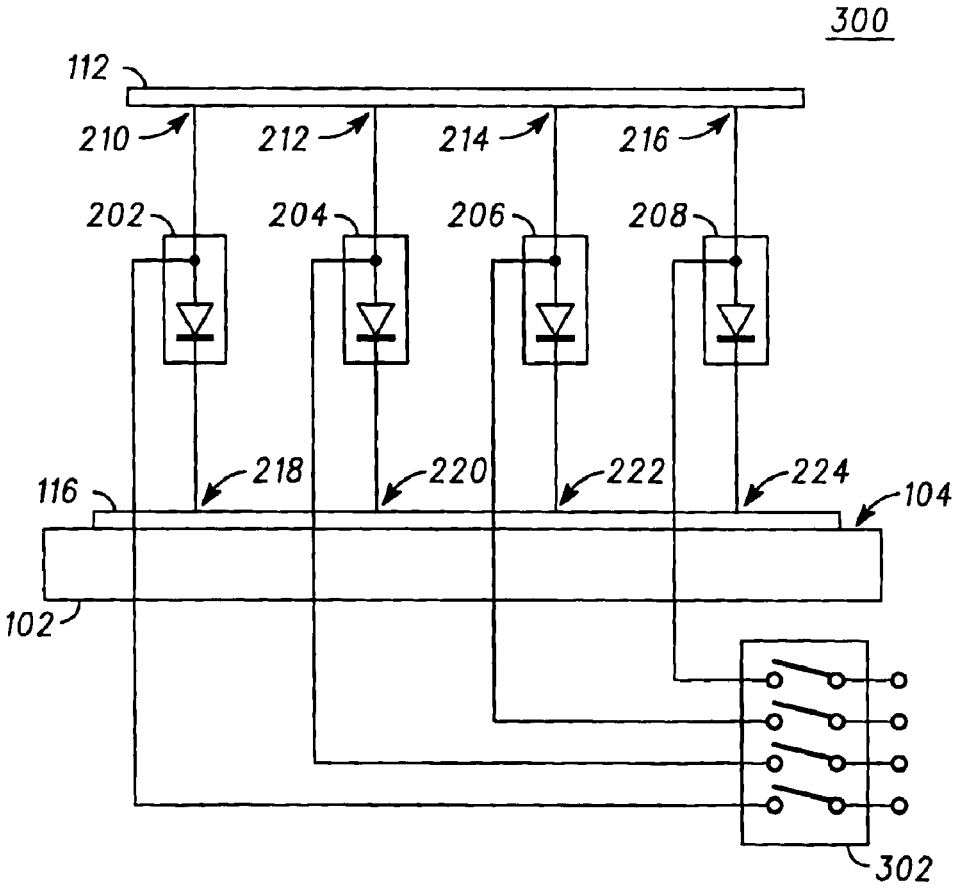
FIG. 3 is an exemplary block diagram of PIN diodes used as switches in accordance with the present invention.
Figure 4:
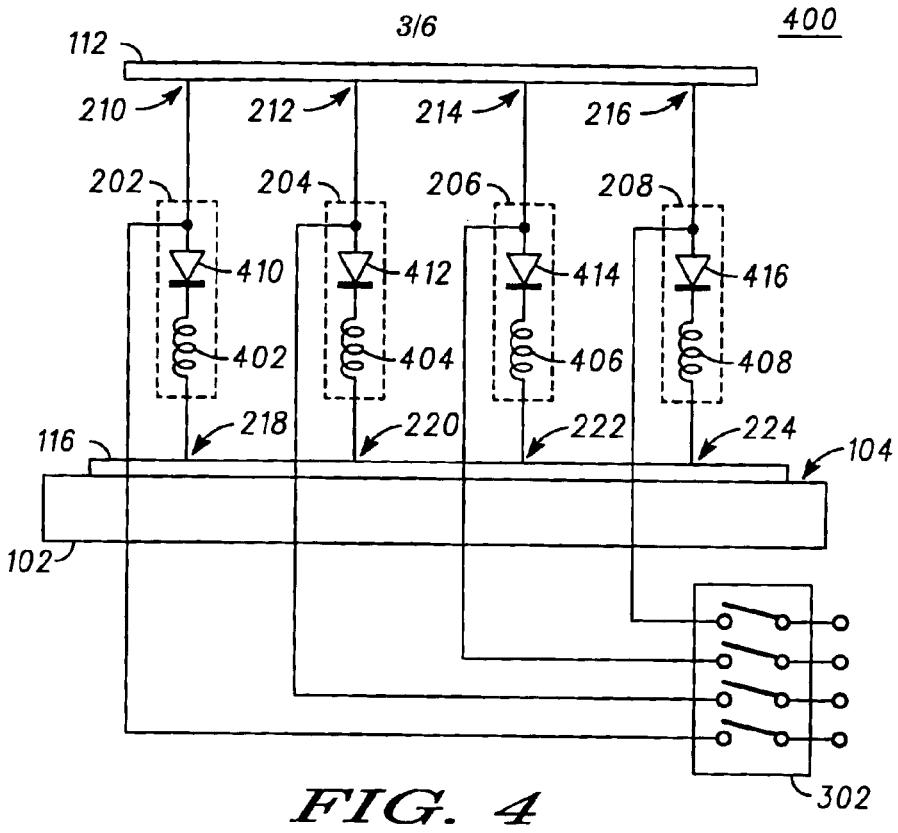
FIG. 4 is an exemplary block diagram of the PIN diode switches coupled to reactive elements in accordance with the present invention.
Figure 5:
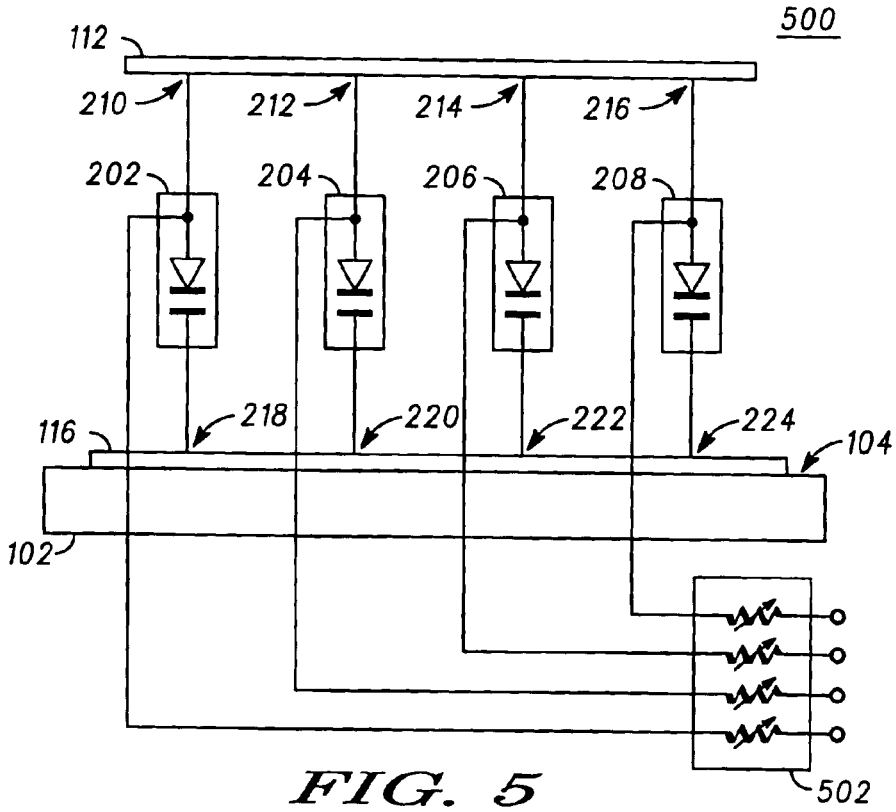
FIG. 5 is an exemplary block diagram of varactor diodes used to provide variable capacitance in accordance with the present invention.

FIG. 3 is an exemplary block diagram 300 of the switches 202, 204, 206, and 208. Each switch configured to couple the conducting element 112 to the conductor 114 is a PIN diode configured to be activated by a selector 302. FIG. 4 is an exemplary block diagram 400 of the PIN diode switches 202, 204, 206, and 208, each of which further comprising a corresponding reactive element to increase or decrease reactance when it is activated to produce desired high impedance at a desired frequency band and is activated by the selector 302. In this example, inductors 402, 404, 406, and 408 as the reactive elements are shown to be connected in series with corresponding PIN diode 410, 412, 414, and 416, respectively, to form switches, 202, 204, 206, and 208, respectively. FIG. 5 is an exemplary block diagram 500 of the switches 202, 204, 206, and 208. Each switch is a varactor diode configured to provide variable capacitance set by a controller 502.

Figure 6:
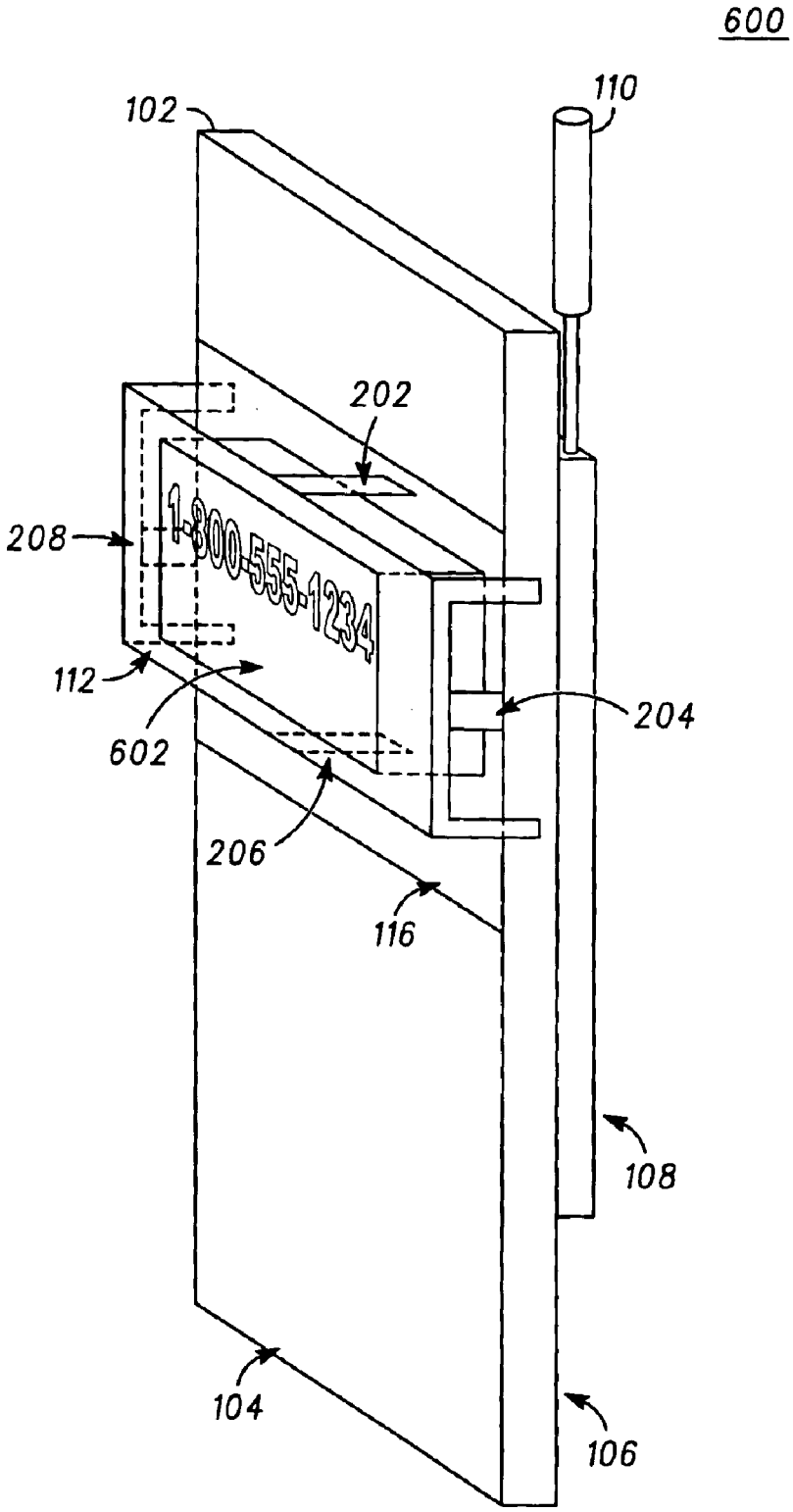
FIG. 6 is an exemplary illustration of a wireless portable communication device utilizing an antenna arrangement in accordance with the present invention.

FIG. 6 is an exemplary illustration of a wireless portable communication device 600 utilizing an antenna arrangement in accordance with the present invention. In this example, the conducting element 112 is a metallic bezel, which holds in place a display 602 of the wireless portable communication device 600 to the printed circuit board 102. The conducting element 112, the metallic bezel, is coupled to the conductor 116, which is electrically grounded, by four switches 202, 204, 206, and 208. As previously described, the switches 202, 204, 206, and 208 may be activated individually or as a combination of any of the switches, and may comprise reactive elements or varactors.

Figure 7:
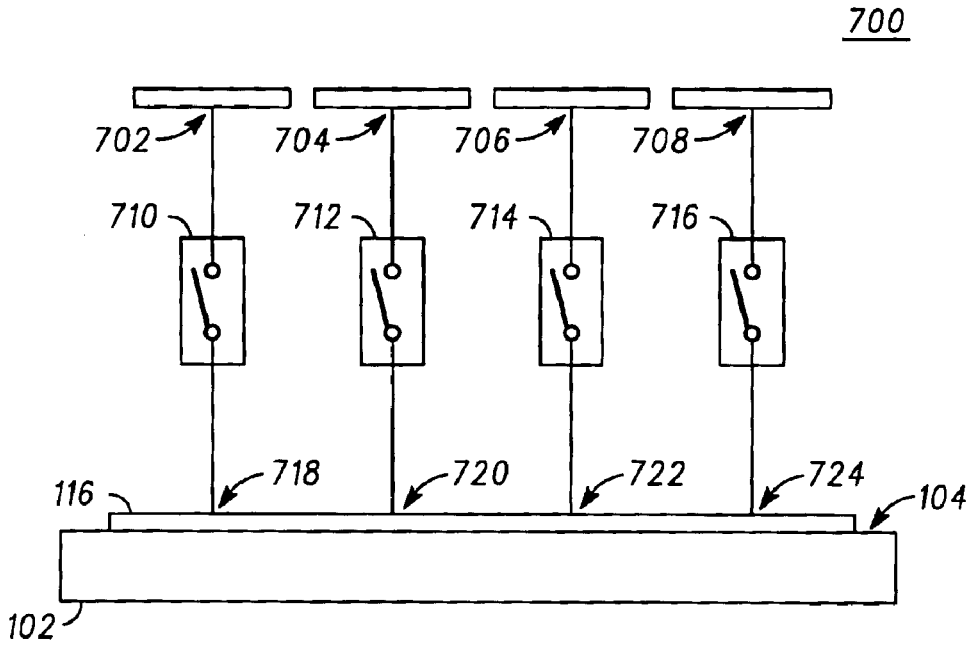
FIG. 7 is an exemplary block diagram of a third embodiment of the antenna arrangement having a plurality of conducting elements in accordance with the present invention.

FIG. 7 is an exemplary block diagram of a third embodiment of the antenna arrangement 700 having a plurality of conducting elements, of which only four conducting elements, 702, 704, 706, and 708 are shown, in accordance with the present invention. The individual conducting elements 702, 704, 706, and 708 are configured to couple to the conductor 116, which is electrically grounded, by their corresponding switches, 710, 712, 714, and 716, respectively, at a plurality of conductor locations, 718, 720, 722, and 724. By coupling different conducting element or elements to the conductor 116, a resulting reactance can be varied to achieve a desired effect of producing high impedance for a given desired transmit frequency to reduce radio frequency current flow on the first side 104 of the printed circuit board 102. For multiple frequency band operations, different sets of switches may be activated to couple different set of conducting elements with each set of conducting elements corresponding to a specific band. For example, a dual band cellular telephone having a first band at GSM 900 MHz band and a second band at GSM 1900 MHz, the switches 710, 712, and 714 may be activated to couple the conducting elements 702, 704, and 706 achieving a desired effect of producing high impedance at the 900 MHz band while only the switch 716 may be activated to couple the conducting element 708 achieving a desired effect of producing high impedance at the 1900 MHz band.

Figure 8:
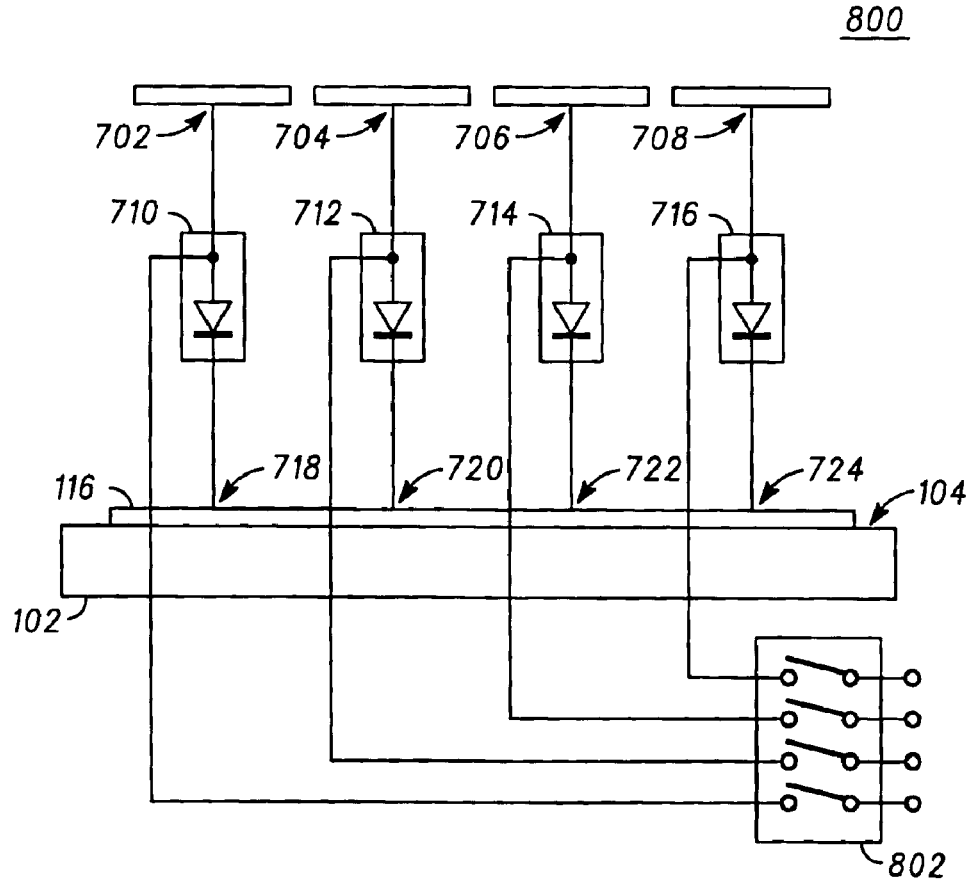
FIG. 8 is an exemplary block diagram of PIN diodes used as switches in accordance with the present invention.
Figure 9:
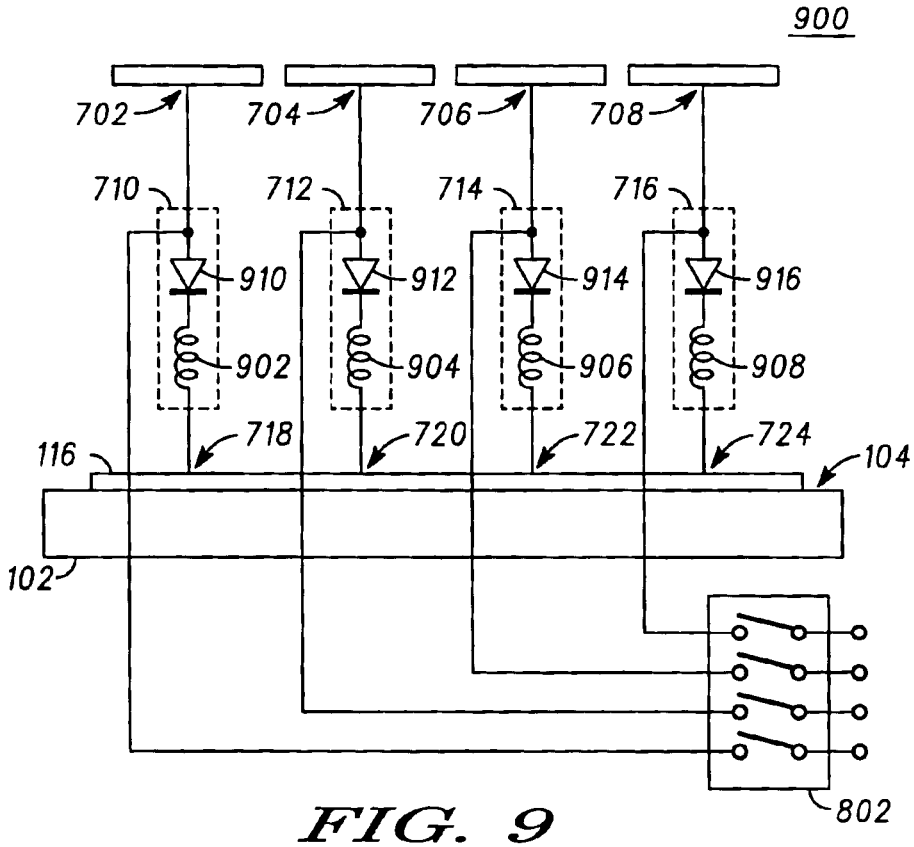
FIG. 9 is an exemplary block diagram of the PIN diode switches coupled to reactive elements in accordance with the present invention.
Figure 10:
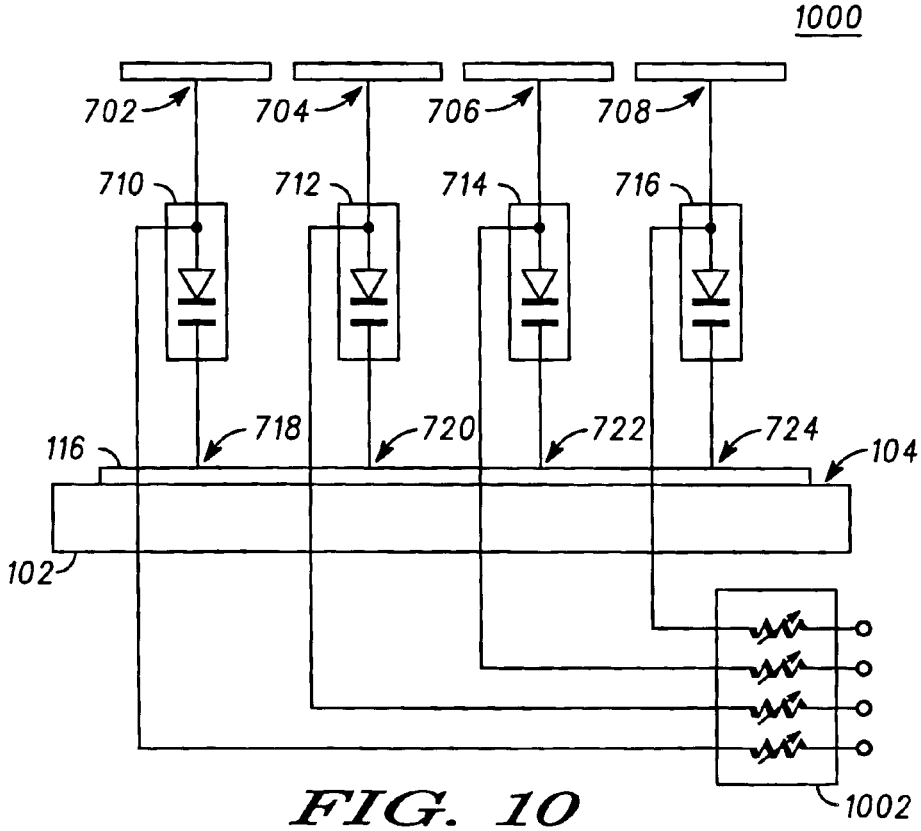
FIG. 10 is an exemplary block diagram of varactor diodes used to provide variable capacitance in accordance with the present invention.

FIG. 8 is an exemplary block diagram 800 of the switches 710, 712, 714, and 716 where each switch is a PIN diode configured to couple the corresponding conducting element 702, 704, 706, or 708 to the conductor 114 by a selector 802. FIG. 9 is an exemplary block diagram 900 of the PIN diode switches 710, 712, 714, and 716, each of which further comprising a corresponding reactive element to increase or decrease reactance when it is activated to produce desired high impedance at a desired frequency band and is activated by the selector 802. In this example, inductors 902, 904, 906, and 908 as the reactive elements are shown to be connected in series with corresponding PIN diode 910, 912, 914, and 916, respectively, to form switches, 710, 712, 714, and 716, respectively. FIG. 10 is an exemplary block diagram 1000 of the switches 710, 712, 714, and 716. Each switch is a varactor diode configured to provide variable capacitance set by a controller 1002.

While the preferred embodiments of the invention have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. An antenna arrangement for a wireless portable communication device, the wireless portable communication device having a transceiver disposed on a printed circuit board, the printed circuit board having first and second sides opposite of each other, the antenna arrangement comprising:

an antenna coupled to the transceiver; and a conducting element suspended substantially parallel to the first side of the printed circuit board, the conducting element coupled to an electrical ground of the printed circuit board, wherein the conducting element presents high impedance at operating frequencies of the wireless portable communication device and diverts radio frequency currents from the first side of the printed circuit board to the second side of the printed circuit board such that a magnetic field produced by the radio frequency currents on the first side of the printed circuit board is reduced in a near-field.

2. The antenna arrangement of claim 1, further comprising a PIN diode configured to couple the conducting element to the electrical ground of the printed circuit board.

3. The antenna arrangement of claim 1, further comprising a plurality of PIN diodes configured to couple the conducting element at a plurality of locations to the electrical ground of the printed circuit board.

4. The antenna arrangement of claim 3, wherein a predetermined set of PIN diodes of the plurality of PIN diodes are configured to couple the conducting element to the electrical ground of the printed circuit board based upon a predetermined range of the operating frequencies.

5. The antenna arrangement of claim 1, further comprising a reactive element configured to couple the conducting element to the electrical ground of the printed circuit board.

6. The antenna arrangement of claim 1, further comprising a plurality of reactive elements configured to couple the conducting element at a plurality of locations to the electrical ground of the printed circuit board.

7. The antenna arrangement of claim 6, wherein a predetermined set of reactive elements of the plurality of reactive elements are configured to couple the conducting element to the electrical ground of the printed circuit board based upon a predetermined range of the operating frequencies.

8. The antenna arrangement of claim 1, further comprising a varactor diode configured to couple the conducting element to the electrical ground of the printed circuit board, the varactor diode further configured to receive a control signal to provide variable capacitance based upon a predetermined range of the operating frequencies.

9. The antenna arrangement of claim 1, wherein the conducting element is a metallic bezel configured to retain a display of the wireless portable communication device.

10. An antenna arrangement for a wireless portable communication device, the wireless portable communication device having a printed circuit board, the printed circuit board having first and second sides opposite of each other, a transceiver disposed on a printed circuit board, the antenna arrangement comprising:

an antenna coupled to the transceiver; and a plurality conducting elements suspended substantially parallel to the first side of the printed circuit board, at least one of the plurality of conducting elements coupled to an electrical ground of the printed circuit board, wherein the at least conducting element of the plurality of conducting elements presents a high impedance at operating frequencies of the wireless portable communication device and diverts radio frequency currents from the first side of the printed circuit board to the second side of the printed circuit board the such that magnetic field produced by the radio frequency currents on the first side of the printed circuit board is reduced in a near-field.

11. The antenna arrangement of claim 10, further comprising a plurality of PIN diodes, each of the plurality of PIN diode configured to couple a corresponding conducing element of the plurality of conducting elements to the electrical ground of the printed circuit board.

12. The antenna arrangement of claim 11, wherein a predetermined set of PIN diodes of the plurality of PIN diodes are configured to couple the corresponding conducting elements to the electrical ground of the printed circuit board based upon a predetermined range of the operating frequencies.

13. The antenna arrangement of claim 11, further comprising a plurality of reactive elements, each of the plurality of reactive elements configured to couple a corresponding conducing element of the plurality of conducting elements to the electrical ground of the printed circuit board.

14. The antenna arrangement of claim 13, wherein a predetermined set of reactive elements of the plurality of reactive elements are configured to couple the corresponding conducting elements to the electrical ground of the printed circuit board based upon a predetermined range of the operating frequencies.

15. A method in a wireless portable communication device for reducing a magnetic field in a near-field on a first side of a printed circuit board, the printed circuit board further having a second side opposite the first side, the method comprising:

suspending a conducting element substantially parallel to the first side of the printed circuit board;

coupling the conducting element to an electrical ground of the printed circuit board;

presenting a high impedance at operating frequencies of the wireless portable communication device with the conducting element; and diverting radio frequency currents to the second side of the printed circuit board from the first side of the printed circuit board.

16. The method of claim 15, wherein coupling the conducting element to an electrical ground of the printed circuit board further comprises coupling the conducting element at a plurality of locations to the electrical ground of the printed circuit board.

17. The method of claim 16, wherein coupling the conducting element at a plurality of locations to the electrical ground of the printed circuit board further comprises coupling the conducting element at a predetermined set of locations of the plurality of locations to the electrical ground of the printed circuit board based upon a predetermined range of the operating frequencies.

18. The method of claim 17, further comprising activating a plurality of PIN diodes to couple the conducting element at the predetermined set of locations of the plurality of locations to the electrical ground of the printed circuit board.

19. The method of claim 15, wherein coupling the conducting element to an electrical ground of the printed circuit board further comprises coupling the conducting element to the electrical ground of the printed circuit board using a PIN diode.

20. The method of claim 15, wherein coupling the conducting element to an electrical ground of the printed circuit board further comprises coupling the conducting element to the electrical ground of the printed circuit board using a reactive element.

* * * * *